US005529559A

United States Patent [19]

Punzalan

[11] Patent Number: 5,529,559

[45] Date of Patent: Jun. 25, 1996

[54] PNEUMATIC VACUUM ISOMETRIC BODY EXERCISER

[76] Inventor: Crispino R. Punzalan, 55 Chestnut St., Nutley, N.J. 07110

[21] Appl. No.: 361,110

[22] Filed: Dec. 21, 1994

[51] Int. Cl.[6] ..... A63B 21/008

[52] U.S. Cl. ..... 482/112; 482/111; 482/128

[58] Field of Search ..... 482/111, 112, 482/113, 53, 58, 73, 128

[56] References Cited

U.S. PATENT DOCUMENTS

| | | | |
|---|---|---|---|
| 3,174,343 | 3/1965 | Kasulis . | |
| 3,471,145 | 10/1969 | Berger . | |
| 4,290,600 | 9/1981 | Kolbel . | |
| 4,333,645 | 6/1982 | Wu . | |
| 4,376,533 | 3/1983 | Kolbel . | |
| 4,772,016 | 9/1988 | Manion . | |
| 4,951,941 | 8/1990 | Resk | 482/112 |
| 5,044,630 | 9/1991 | Ventimiglia . | |
| 5,152,732 | 10/1992 | Sayre . | |
| 5,261,867 | 11/1993 | Chen | 482/112 |

FOREIGN PATENT DOCUMENTS

| | | |
|---|---|---|
| 1365888 | 12/1970 | United Kingdom . |
| 1362798 | 12/1970 | United Kingdom . |
| 2031285 | 10/1978 | United Kingdom . |

*Primary Examiner*—Lynne A. Reichard
*Attorney, Agent, or Firm*—Lackenbach Siegel Marzullo Aronson and Greenspan

[57] ABSTRACT

The present invention provides a pneumatic vacuum isometric body exerciser for use by an individual for training muscle groups. The exerciser has a piston slidingly disposed in a cylinder such that the relative axial movement of the piston in the cylinder causes a pressure condition in the cylinder. A piston rod, connected to the piston, is located within the cylinder. Rotatable bearing surfaces are located between an outer wall of the piston rod, or piston, and an inner wall of the cylinder. A means for applying a force against the bearing surfaces allows for the resistance of the exerciser to be varied.

The present invention also provides a portable pneumatic vacuum isometric body exerciser with an air passage way located at a distal end of a cylinder. A pressure relief valve regulates the flow of air through the air passage way. The valve has a slidable valve element located relative to the air passage way.

13 Claims, 3 Drawing Sheets

PNEUMATIC VACUUM ISOMETRIC BODY EXERCISER

BACKGROUND OF THE INVENTION

This invention relates to a portable exercise device; and, more particularly, it relates to a pneumatic vacuum isometric body exerciser for working various muscle groups. Recently, there has been a growing trend in the number of people using various types of portable exercisers. Portable exercisers frequently use resistance. The use of resistance in a workout has been found to rapidly tone and develop muscles, as well as provide cardiovascular benefits. Notwithstanding the benefits to be gained by the use of these resistance exercisers, there are several problems inherent in the use of pneumatic exercisers which operate on the principle of compressing and expanding gases. Examples of such exercisers can be found in U.S. Pat. Nos. 3,174,343, 3,471,145, 4,290,600, 4,333,645, 4,376,533, 4,772,016, 5,004,630, and 5,152,732.

One problem with these exercisers involves the variability of resistance during compression and expansion strokes. Some exercisers do not offer the ability to vary resistance during compression and expansion strokes of the exerciser, e.g. U.S. Pat. Nos. 4,290,600, and 4,376,533. Of the types of exercisers found in the art that offer variable resistance during compression and expansion strokes, resistance is regulated by adjusting the flow of air through a valve or internal bore, e.g. U.S. Pat. Nos. 3,174,343, 3,471,145, 4,333,645, 4,772,016, and 5,044,630. However, as the piston seals in these devices wear over time the resistance variability these devices offer decreases.

A secondary problem associated with devices in the art involves a lack of stability during expansion and compression strokes. These devices contain both a piston and a piston rod. However, the piston rods in these devices are not stabilized so as to allow for a smooth lateral stroke during expansion and compression strokes, e.g. U.S. Pat. Nos. 4,3321,645, 4,772,016, and 5,044,630.

It would be highly desirable to solve the plethora of problems faced in the art and it is an object of the present invention to solve these problems. The present invention targets the thousands of health conscious individuals who train annually in the United States and worldwide, and serves these markets by providing a pneumatic vacuum isometric body exerciser that allows for increased variability of resistance, and that allows for increased smoothness of use during expansion and compression strokes.

SUMMARY OF THE INVENTION

The present invention provides a pneumatic vacuum isometric body exerciser for use by an individual for training muscle groups. The exerciser has a piston slidingly disposed in a cylinder such that the relative axial movement of the piston in the cylinder causes a pressure condition in the cylinder. A piston rod, connected to the piston, is located within the cylinder. Rotatable bearing surfaces are located between an outer wall of the piston rod, or piston, and an inner wall of the cylinder. The present invention further provides a means for applying a force against the bearing surfaces.

In one embodiment, a means for varying the size and shape of a resilient bushing regulates the force applied to the bearing surfaces. In another embodiment, a means for applying a force against a plurality of cantilevered prongs regulates the force exerted on the bearing surfaces. The bearing surfaces rest on the cantilevered prongs between an outside surface of the piston rod and the cantilevered prongs. The bearing surfaces-may also rest between an inside surface of the cylinder and the cantilevered prongs.

In yet a further embodiment, means for applying a force against a plurality of cantilevered prongs consists of an end cap where translational or rotational movement of the end cap causes a change in force exerted on the cantilevered prongs, and bearing surfaces.

The present invention also provides a portable pneumatic vacuum isometric body exerciser with an air passage way located at a distal end of a cylinder. A pressure relief valve regulates the flow of air through the air passage way. The valve has a slidable valve element located relative to the air passage way. The slidable valve element has a first edge and a second edge. Rotation of the first edge and second edge of the valve element is restricted by a limit stop.

DETAILED DESCRIPTION OF THE INVENTION

Figure 1:
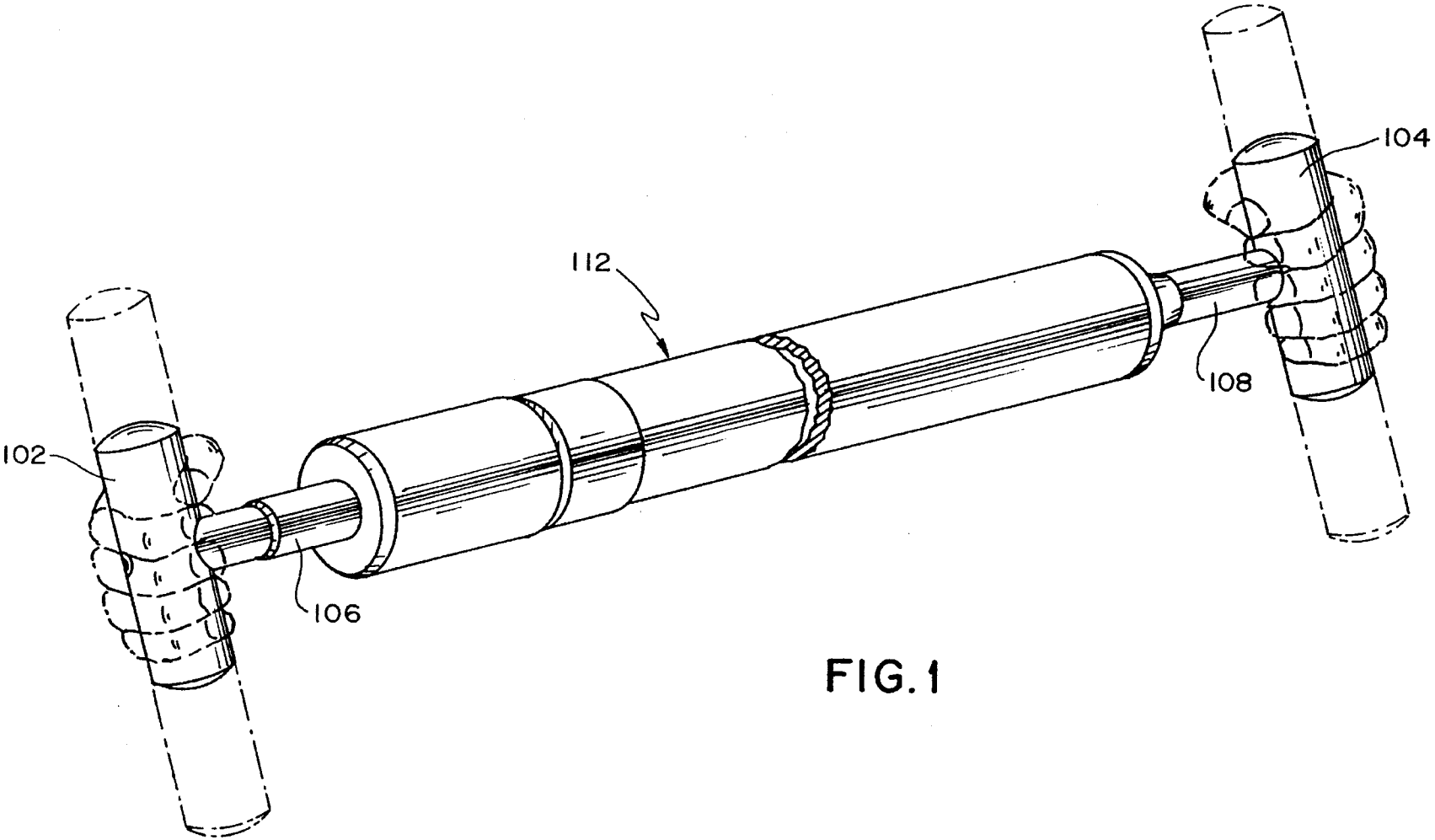
FIG. 1 is an overall perspective view of a pneumatic vacuum isometric body exerciser.

FIG. 1 is an overall perspective view of a pneumatic vacuum isometric body exerciser 100. Exerciser 100, as viewed in FIGS. 1, 2, and 4 contains handles 102, 104. Handle 104 is connected to the distal end of shaft 108. Handle 102 is connected to the distal end of piston rod 106 (FIGS. 1, 2, 2A, and 4). Piston rod 106 is fixed to handle 102 as viewed in FIGS. 2 and 4. The present invention contemplates that ropes or other types of handles made for exercising different muscle groups can be attached to shaft 108 and piston rod 106 as appropriate.

Figure 2A:
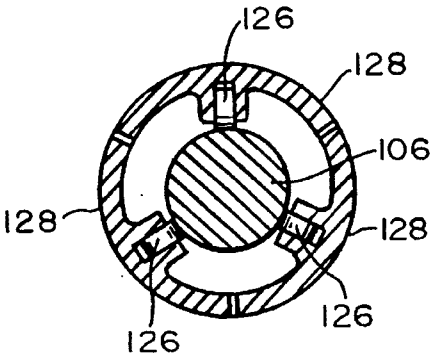
FIG. 2A is a cross-sectional view of a plurality of cantilevered prongs and bearing surfaces, and piston rod of the exerciser of FIG. 2.
Figure 2:
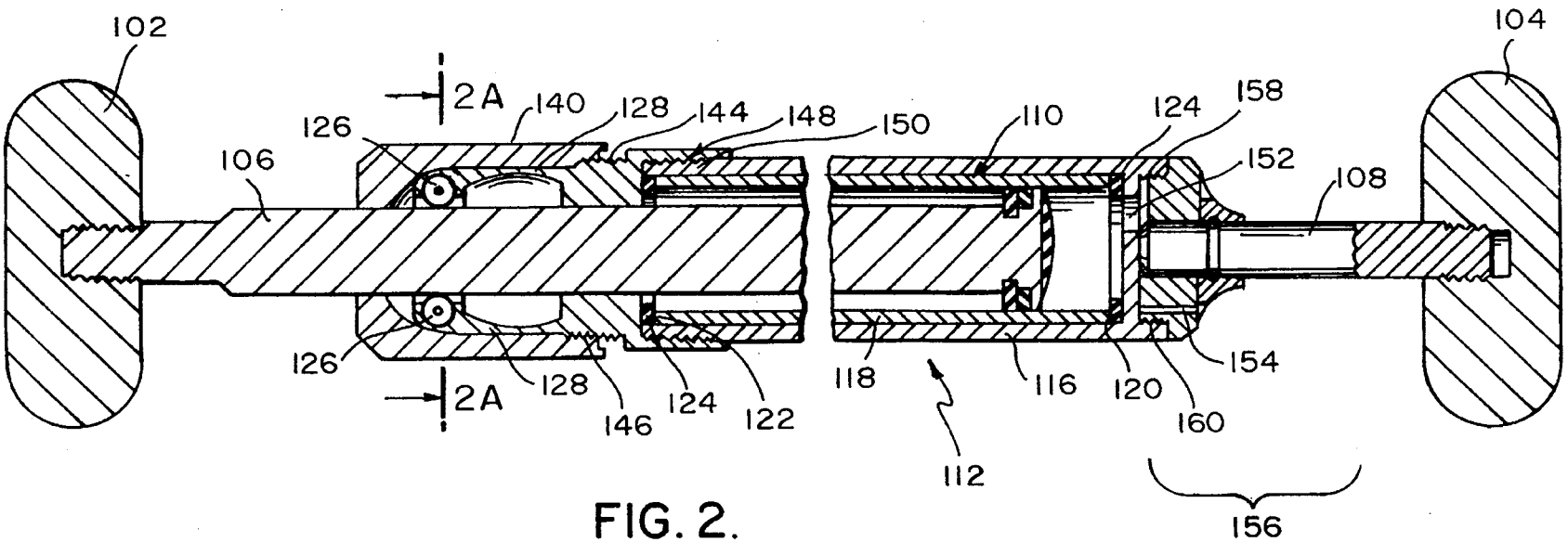
FIG. 2 is a side cross-sectional view of the pneumatic vacuum isometric body exerciser of FIG. 1.
Figure 4:
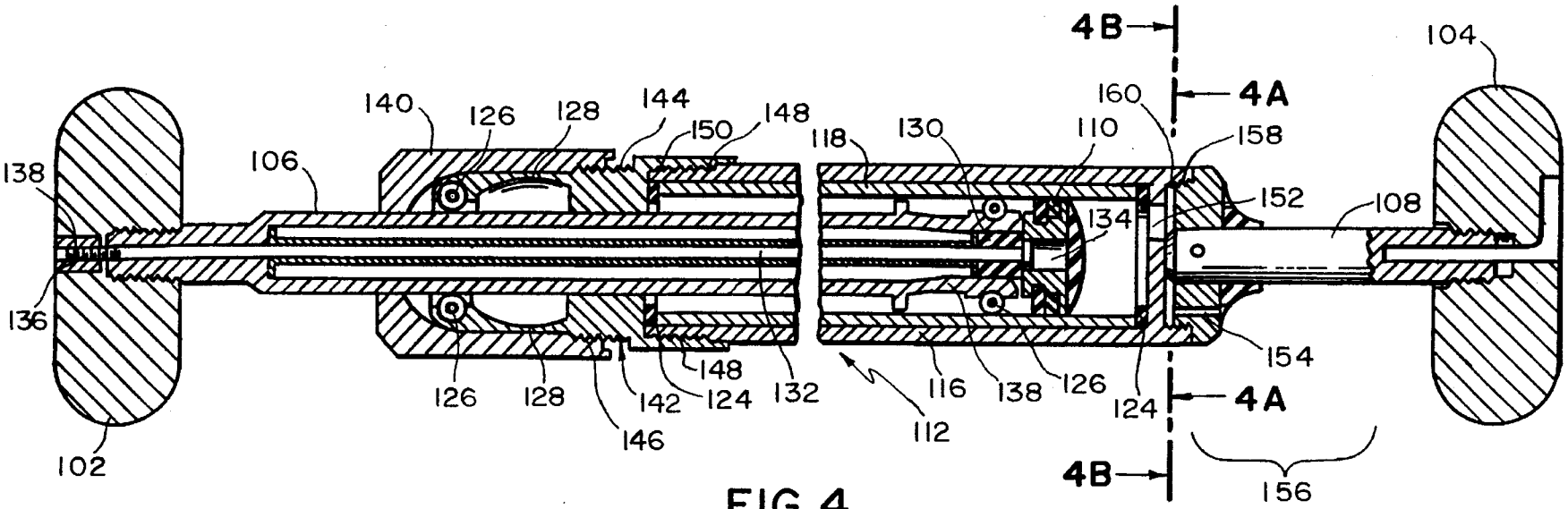
FIG. 4 is a side cross-sectional view of the pneumatic vacuum isometric body exerciser of FIG. 2 with the addition of a second means for applying a force against a plurality of cantilevered prongs and bearing surfaces.

Piston rod 106 is fixed to piston 110 (FIGS. 2 and 4). Piston 110 is slidingly disposed in cylinder 112 such that the relative axial movement of piston 110 in cylinder 112 causes a pressure condition in cylinder 112 (FIGS. 2 and 4). The pressure condition includes an increased pressure condition or a vacuum condition.

In a preferred embodiment, cylinder 112 comprises main body 116. Main body 116 is composed of plastic, metal, fiberglass, composites, graphite, or other suitable material. Disposed within main body 116 is inner cylinder member 118. Inner cylinder member 118 is constructed from metal, plastic or other suitable material. Inner cylinder member 118 has a first open end 120 and a second open end 122 (FIGS. 2 and 4). Disposed at ends 120, 122 are gaskets 124. Gaskets 124 serve to seal inner cylinder 112, main body 116, and end cap 142.

As viewed in FIGS. 2, 2A, 3 and 4, bearing surfaces 126 are rotatably disposed between piston rod 106 and an inner wall of cylinder 112. Bearing surfaces 126 are ball bearings in one embodiment, or bushings in a preferred embodiment. As viewed in the embodiment of FIG. 4, the inner wall of cylinder 112 comprises the interior portion of inner cylinder member 118. As viewed in the embodiment of FIGS. 2, 2A, 3, and 4, the inner wall of cylinder 112 includes the interior portion of cantilever prongs 128.

Means for applying a force against bearing surfaces 126 are disposed within cylinder 112. In one embodiment, a means for varying the size and shape of resilient bushing 130 (FIG. 4) exerts a forces on bearing surfaces 126. Resilient bushing 130 is disposed in piston rod 108. Resilient bushing 130 exerts a force against bearing surfaces 126 upon compression of bushing 130. Compression of bushing 130 is achieved when end cap 134 of inner rod 132, which is slidably disposed in piston rod 106, moves toward the distal end of piston rod 106. In a preferred embodiment, inner rod 132 has a threaded male end 136. Threaded end 136 is drawn into threaded female end 138 disposed within handle 102 with a screw driver or allen wrench (not shown).

The compression of bushing 130 results in a force exerted on cantilevered prongs 138 (FIG. 4). Prongs 138 exert a force against bearing surfaces 126. Varying the force exerted against bearing surfaces 126 will vary the amount of frictional force between bearing surfaces 126 and inner wall 118. It will be further appreciated that the amount of frictional force between bearing surfaces 126 and inner wall 118 is proportional to the resistance muscle groups are required to overcome when compressing and expanding exerciser 100.

Figure 3:
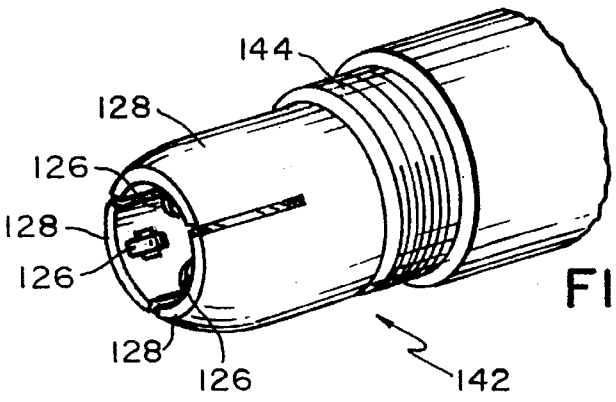
FIG. 3 is an exploded perspective view of a cantilevered prong and bearing surface assembly of FIG.2.

In another embodiment, means for applying a force against bearing surfaces 126 include cantilevered prongs 128, end cap 140, and cantilevered prong housing 142 (FIGS. 2, 3, and 4). Rotational movement of end cap 140 causes a change in force exerted on cantilevered prongs 128. End cap 140 has a threaded socket 146 (FIGS. 2 and 4) mating with threads 144 disposed on prong housing 142 (FIGS. 2, 3 and 4). Prong housing 142 in turn includes threads 148 mating with threads 150 disposed at a distal end of main body 116.

The present invention contemplates that translational movement of end cap 140 along the axis of cylinder 112 causes a change in force exerted on cantilevered prongs 128. In this embodiment, end cap 140 has male beads disposed on an inner surface of end cap 140 similarly disposed as threads 146. These male beads interact with parallel grooves on the outer surface of prong housing 142 to allow translational movement of end cap 140 along prong housing 142.

It will be appreciated that rotational or translational movement of end cap 140 serves to increase or decrease pressure on cantilever prongs 128, increasing or decreasing the frictional force between bearing surfaces 126 and piston rod 106. The variation in frictional force allows for resistance to be varied as handles 102, 104 are brought inward or extended outward.

Cylinder 112 has air passage way 152 disposed at a distal end of cylinder 112. In a preferred embodiment, passage way 152 is disposed in main body 116 (FIGS. 2, 4, and 4A) and is in the shape of a crescent. A pressure relief valve 156 (FIGS. 2 and 4) regulating the flow of air through passage way 152 is disposed at a distal end of cylinder 112, proximal to passage way 152. Valve 156 has threads 158 which mate with threads 160 disposed on main body 116.

Figure 4B:
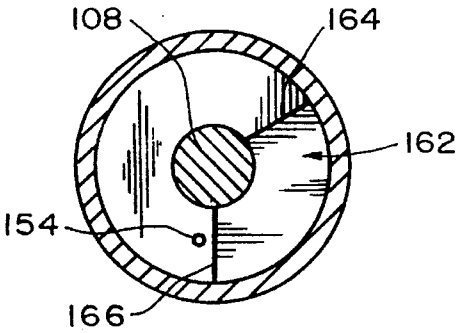
FIG. 4B is an exploded side cross-sectional view of the valve of FIG. 4 with a slidable valve element located relative to an air hole, and a handle shaft.
Figure 4A:
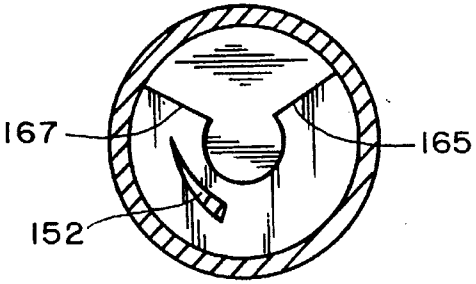
FIG. 4A is an exploded side cross-sectional view of the valve of FIG. 4 with an air passage way located at a distal end of the cylinder and a limit stop.

As viewed in FIG. 4B, valve 156 has a slidable valve element said slidable valve element 162 having a first edge 164 and a second edge 166. Valve element 162 rotates around the axis of shaft 108 (FIG. 4B) along with shaft 108. Rotation of first edge 164 is restricted by limit stop 167 and rotation of second edge 166 is restricted by a limit stop 165 (FIG. 4A). In a preferred embodiment valve element 162 occupies an arc of 120 degrees.

Air hole 152 (FIGS. 2, 4, and 4B) is disposed in valve 156 allowing for passage of compressed air as piston head 110 travels through cylinder 112. It will be appreciated that a means for applying force against bearing surfaces 126 in combination with valve 152, and air hole 154 allow for the resistance of exerciser 100 to be varied by a number of methods described herein.

While only a few, preferred embodiments of the invention have been described hereinabove, those of ordinary skill in the art will recognize that the embodiment may be modified and altered without departing from the central spirit and scope of the invention. Thus, the preferred embodiment described hereinabove is to be considered in all respects as illustrative and not restrictive, the scope of the invention being indicated by the appended claims, rather than by the foregoing description, and all changes which come within the meaning and range of equivalency of the claims are intended to be embraced herein.

I claim:

1. A portable pneumatic vacuum isometric body exerciser for working muscle,, groups, comprising:

(a) a piston slidingly disposed in a cylinder such that the relative axial movement of said piston in said cylinder causes a pressure condition in the cylinder;

(b) a piston rod disposed within said cylinder, said piston rod connected to said piston;

(c) bearings rotatably disposed between an outer wall of said piston rod and an inner wall of said cylinder; and, (d) means for applying a force against said bearings, said bearings moving toward said inner wall of said cylinder upon application of said force.

2. The exerciser of claim 1 wherein said means for applying said force against said bearings further comprises a resilient bushing disposed within said piston rod said resilient bushing exerting a force against a plurality of cantilevered prongs said cantilevered prongs exerting a force against said bearings upon compression, said bearings disposed on said cantilevered prongs.

3. The exerciser of claim 1 wherein said means for applying said force against said bearings further comprises:

(a) a resilient bushing disposed within said piston rod;

(b) a rod with an end cap disposed within said piston rod for compressing said resilient bushing; and, (c) a plurality of cantilevered prongs responsive to movement of said resilient bushing said bearings disposed on said cantilevered prongs.

4. A portable pneumatic vacuum isometric body exerciser for working muscle groups, comprising:

(a) a piston slidingly disposed in a cylinder such that the relative axial movement of said piston in said cylinder causes a pressure condition in the cylinder;

(b) a piston rod disposed within said cylinder, said piston rod connected to said piston;

(c) bearings rotatably disposed between an outer wall of said piston rod and an inner wall of said cylinder; and, (d) means for applying a force against a plurality of cantilevered prongs said bearings disposed on said prongs.

5. The exerciser of claim 4 wherein said means for applying said force against a plurality of cantilevered prongs comprises an end cap wherein translational movement of said end cap along an axis of said cylinder causes a change in force exerted on said cantilevered prongs.

6. The exerciser of claim 4 wherein said means for applying said force against a plurality of cantilevered prongs comprises an end cap wherein rotational movement of said end cap causes a change in force exerted on said cantilevered prongs.

7. A portable pneumatic vacuum isometric body exerciser for working muscle groups, comprising:

(a) a piston slidingly disposed in a cylinder such that the relative axial movement of said piston in said cylinder causes a pressure condition in the cylinder;

(b) a piston rod disposed within said cylinder, said piston rod connected to said piston;

(c) a first air passage way disposed at a distal end of said cylinder; and, (d) a pressure relief valve adjustably regulating the flow of air through said passage way wherein said valve has a slidable valve element said slidable valve element having a first edge and a second edge wherein rotation of said first edge and second edge is restricted by a limit stop.

8. The exerciser of claim 7 further comprising:

(a) bearings rotatably disposed between an outer wall of said piston rod and an inner wall of said cylinder; and, (b) means for applying a force against said bearings, said bearings moving toward said inner wall of said cylinder upon application of said force.

9. The exerciser of claim 8 wherein said means for applying said force against said bearings further comprises a resilient bushing disposed within said piston rod said resilient bushing exerting a force against said bearings upon compression of said resilient bushing.

10. The exerciser of claim 8 wherein said means for applying said force against said bearings further comprises:

(a) a resilient bushing disposed within said piston rod;

(b) a rod with an end cap disposed within said piston rod for compressing said resilient bushing; and, (c) a plurality of cantilevered prongs responsive to movement of said resilient bushing said bearings disposed on said cantilevered prongs.

11. The exerciser of claim 8 further comprising:

(a) bearings rotatably disposed between an outer wall of said piston rod and an inner wall of said cylinder; and, (b) means for applying a force against a plurality of cantilevered prongs said bearings disposed on said prongs.

12. The exerciser of claim 11 wherein said means for applying said force against a plurality of cantilevered prongs comprises an end cap wherein translational movement of said end cap along an axis of said cylinder causes a change in force exerted on said cantilevered prongs.

13. The exerciser of claim 11 wherein said means for applying said force against a plurality of cantilevered prongs comprises an end cap wherein rotational movement of said end cap causes a change in force exerted on said cantilevered prongs.

* * * * *